United States Patent [19]

Wopschall

[11] 3,941,384

[45] Mar. 2, 1976

[54] BALLOON CARRIED BASKET FOR BALL GAME

[76] Inventor: Paul R. Wopschall, 3248 Carlsbad Blvd., Carlsbad, Calif. 92008

[22] Filed: Feb. 7, 1975

[21] Appl. No.: 547,810

[52] U.S. Cl. ..... 273/105 R; 46/88; 244/31

[51] Int. Cl.[2] ..... A63B 71/02

[58] Field of Search ..... 244/31; 46/87, 88; 273/95 R, 105 R, 102 R; 272/1 B

[56] References Cited

UNITED STATES PATENTS

| | | | |
|---|---|---|---|
| 2,804,123 | 8/1957 | Kling | 46/87 |
| 3,163,419 | 12/1964 | Lemelson | 46/87 |
| 3,345,646 | 10/1967 | McCann | 46/88 |
| 3,430,958 | 3/1969 | Lakeman | 273/105 R |
| 3,469,844 | 9/1969 | Sindelar | 273/105 R |
| 3,582,078 | 6/1971 | Katras | 273/105 R |
| 3,656,749 | 4/1972 | Reyes | 273/105 R |

*Primary Examiner*—Paul E. Shapiro
*Assistant Examiner*—Marvin Siskind
*Attorney, Agent, or Firm*—D. Gordon Angus; Donald D. Mon

[57] ABSTRACT

Equipment for playing hoop ball comprises a hollow inflatable balloon of toroidal shape having a central circular opening of sufficient diameter for passing a ball through it. A basket which may be somewhat similar to a basket used in playing basketball is attached to the balloon around the central opening and a tether is attached to the basket and secured to a suitable anchoring device which may be placed on the ground so that when inflated with a gas lighter than air, the balloon floats upward to an extent permitted by the length of the tether and in a position such that the central toroidal axis is in a vertical position so that a ball thrown upward can drop through the central opening and into the basket.

2 Claims, 2 Drawing Figures

BALLOON CARRIED BASKET FOR BALL GAME

This invention relates to equipment for use in a hoop-ball or basketball type of sport.

An object of the invention is to provide such equipment which can easily be transported to a park or beach or a picnic ground or the like and set up to provide an elevated basket somewhat similar to that used in a basketball game into which a ball may be thrown from beneath it.

The invention is carried out by provision of an inflatable toroidal-shaped balloon adapted to contain a lighter-than-air type of gas. A basket or net which may be of a fabric somewhat similar to that used in a basketball game is fastened to the balloon around its central opening. A tether cord arrangement is attached to the equipment and arranged to be attached to a base position which may be at the ground. When a ball is thrown upward so that it drops through the central opening of the balloon into the basket the basket will hold the ball, and the weight of the ball will usually be sufficient to carry the balloon down to its base where the ball may be retrieved.

Figure 1:
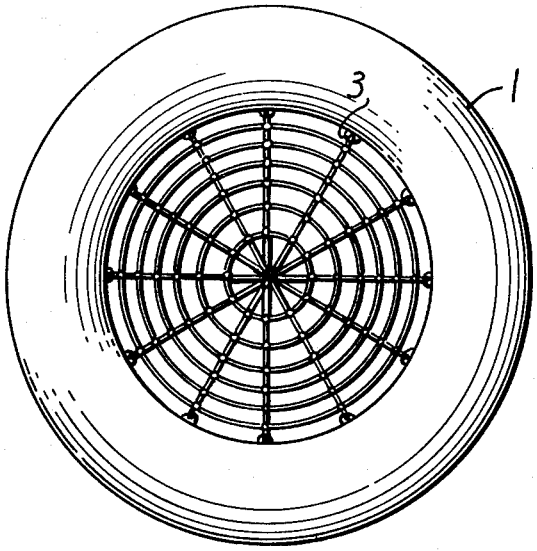
Figure 2:
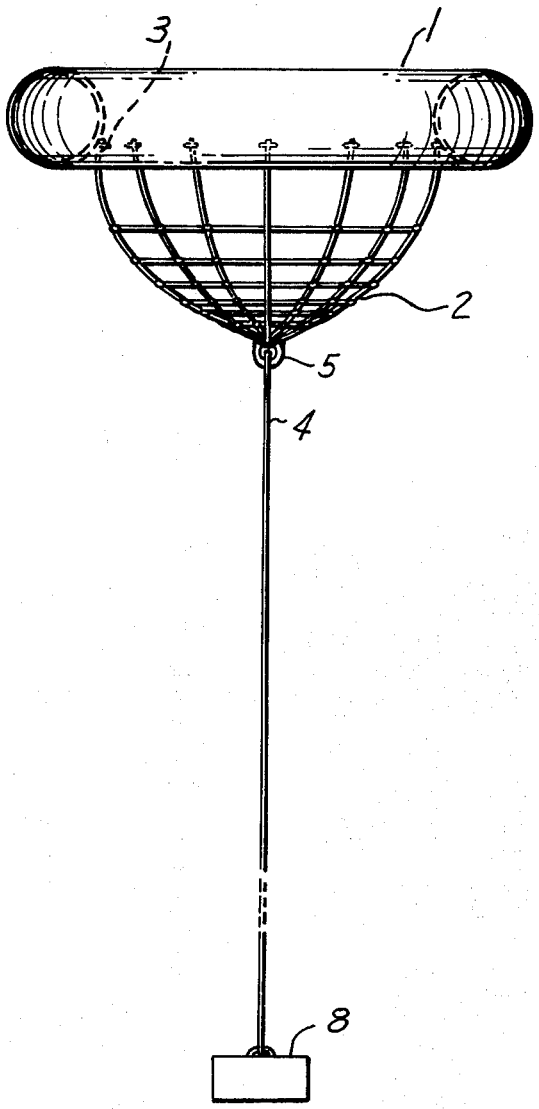

The foregoing and other features of the invention will be better understood from the following detailed description and the accompanying drawing of which:

FIG. 1 is a side elevation view showing a balloon with a net and tethers, according to this invention; and FIG. 2 is a top plan view of the equipment of FIG. 1.

Referring to the drawing there is shown a balloon 1 in the form of a hollow doughnut or toroid, which may be shaped somewhat like an inner tube of an automobile or truck tire, containing a gas lighter than air, so that the balloon will rise in the air. A basket 2 is hung from, or attached to, a circular part of the balloon at a position at or near the inner periphery of the balloon, from suitable fastening members 3 which are attached to the balloon, as by cement. The basket shown in the drawing is similar to a basketball net except that it is substantially closed at the bottom so that it will hold a ball of a type likely to be used with it. A tether 4 is attached to a fastening member 5 at a central position at the bottom of the basket and brought down to a base, ordinarily the ground, for fastening to a suitable object, for example a brick or the like 8.

The balloon may be of the permanently inflated type which may be sealed with the gas in it. It will generally be more convenient, however, to provide for transporting the balloon in a deflated condition, in which case the balloon will have a suitable valve through its envelope. As such valves for a balloon are well known, no valve is shown in the drawing. The process of inflating such a balloon having a valve can be done by use of a tank or container of pressurized gas. The preferred gas is helium or other light non-flammable gas, but other light gases may be used instead, for example hydrogen or a light hydrocarbon gas.

The material of the wall or skin of the balloon may be of any suitable lightweight, flexible gas-retaining fabric or material such as are well known in the art. These may include rubber, plastic or other fabrics.

From the drawing and the foregoing description it is seen that the equipment can be carried to a desired place and when the balloon is inflated, a suitable length of the tether 4 will be selected for attachment to the anchor member 8 and the balloon released. The balloon will then float upward until the tether becomes taut. The balloon will float in the air in the desired position wherein the area through its central opening is horizontal, that is, the central axis is vertical.

I claim:

1. Equipment for playing hoop ball comprising:

a balloon having a wall of toroidal shape and having a central circular opening of great enough diameter for passage of a ball through it, said wall being hollow and filled with a gas lighter than air;

a basket having a circular upper edge attached around a circular part of the balloon encompassing the circular opening, said basket being sufficiently closed at its bottom to hold the ball;

tether means attached to the equipment; and means attaching said tether means to a base at a position beneath the center of the basket.

2. Equipment according to claim 1 in which the tether means attached to the equipment comprises a tether attached to the bottom of the basket at a central position thereof.

* * * * *